United States Patent [19]

Nogami et al.

[11] Patent Number: 4,586,478

[45] Date of Patent: May 6, 1986

[54] AIR-FUEL RATIO CONTROL METHOD AND APPARATUS FOR AN INTERNAL COMBUSTION ENGINE

[75] Inventors: Susumu Nogami; Yukio Suzuki; Hiroshi Takahashi; Kan Otsuka, all of Toyota, Japan

[73] Assignee: Toyota Jidosha Kabushiki Kaisha, Toyota, Japan

[21] Appl. No.: 406,528

[22] Filed: Aug. 9, 1982

[30] Foreign Application Priority Data

Aug. 13, 1981 [JP] Japan ..... 56-125987

[51] Int. Cl.[4] ..... F02M 51/00

[52] U.S. Cl. ..... 123/489; 123/492

[58] Field of Search ..... 123/440, 489, 492

[56] References Cited

U.S. PATENT DOCUMENTS 3,971,354 7/1976 Luchaco et al. ..... 123/492 X
3,983,850 10/1976 Stumpp et al. ..... 123/492 X
4,143,623 3/1979 Norimatsu et al. ..... 123/492 X
4,187,812 2/1980 Hosaka et al. ..... 123/489 X
4,240,389 12/1980 Shimazaki ..... 123/492
4,375,210 3/1983 Ohara et al. ..... 123/492 X
4,398,517 8/1983 Kubota et al. ..... 123/440
4,498,441 2/1985 Ohgami et al. ..... 123/440

*Primary Examiner*—Tony M. Argenbright
*Attorney, Agent, or Firm*—Cushman, Darby & Cushman

[57] ABSTRACT

Closed-loop air-fuel ratio control performed by detecting the concentration of a predetermined component in the exhaust gas, by calculating an air-fuel ratio correction factor depending upon the detected concentration, and by correcting the fuel amount in accordance with the air-fuel ratio correction factor even when the engine is warming up. This closed-loop air-fuel ratio control operation is stopped by fixing the air-fuel ratio correction factor to a predetermined value when the engine is under acceleration during warm-up.

8 Claims, 9 Drawing Figures

AIR-FUEL RATIO CONTROL METHOD AND APPARATUS FOR AN INTERNAL COMBUSTION ENGINE

BACKGROUND OF THE INVENTION

The present invention relates to an air-fuel ratio closed-loop control method and apparatus for an internal combustion engine.

It is a well-known practice to provide an internal combustion engine with an air-fuel ratio closed-loop control system. Such a system calculates an air-fuel ratio correction factor responsive to a detection signal fed from a concentration sensor. The sensor detects the concentration of a particular component contained in the exhaust gas. An example of such a sensor is an oxygen concentration sensor ($O_2$ sensor) for detecting the concentration of oxygen in the exhaust gas. The air-fuel ratio closed-loop control system corrects the amount of the fuel injected into the engine according to the calculated correction factor so as to control the air-fuel ratio to the desired value.

One type of air-fuel ratio closed-loop control system controls the air-fuel ratio if the $O_2$ sensor is active even when the engine is warming up.

During warm-up, engines are generally supplied with an amount of fuel greater than usual (warm-up increment correction) and the air-fuel ratio is set at a richer condition than after warm-up. Therefore, when air-fuel ratio closed-loop control is carried out during warm-up, the air-fuel ratio correction factor is maintained at a value to change the air-fuel ratio to a leaner condition, in other words, at a value to decrease the fuel supplying amount. This allows the air-fuel ratio to be controlled to a desired value, for example, to a stoichiometric value. When the throttle valve is closed during engine warm-up, the intake manifold vacuum pressure is very high. As a result, the fuel vaporizes very well and the engine air-fuel ratio becomes richer. Under such conditions, the air-fuel ratio correction factor is maintained by the closed-loop at a value to greatly change the air-fuel ratio to a leaner condition.

If the engine is accelerated under the above conditions since the air-fuel ratio correction factor has been maintained at a value to change the engine air-fuel ratio to a leaner condition, the fuel is continues to be decreased inspite of the fuel-increment operation at acceleration (acceleration increment correction). As a result, the engine is not supplied with sufficient fuel for acceleration for a while. This causes sluggish acceleration and backfire. In other words, according to the above-mentioned conventional system, good acceleration characteristics cannot be obtained.

SUMMARY OF THE INVENTION

It is, therefore, an object of the present invention to provide an air-fuel ratio control method and apparatus whereby good acceleration characteristics can be obtained when the engine is accelerated under closed-loop air-fuel ratio control during warm-up.

An air-fuel ratio control method according to the present invention includes the steps of: detecting the engine temperature to discriminate whether or not the engine is under warm-up; detecting whether or not the engine is under acceleration; and stopping the closed-loop air-fuel ratio control operation, by fixing the air-fuel ratio correction factor to a predetermined value, when the engine is under acceleration during warm-up.

An air-fuel ratio control apparatus according to the present invention includes means for detecting the engine temperature to discriminate whether or not the engine is under warm-up; means for detecting whether or not the engine is under acceleration; and means for stopping the closed-loop air-fuel ratio control operation, by fixing the air-fuel ratio correction factor to a predetermined value, when the engine is under acceleration during warm-up.

The above and other related objects and features of the present invention will be apparent from the description of the present invention set forth below, with reference to the accompanying drawings, as well as from the appended claims.

DETAILED DESCRIPTION OF THE PREFERRED EMBODIMENTS

Figure 1:
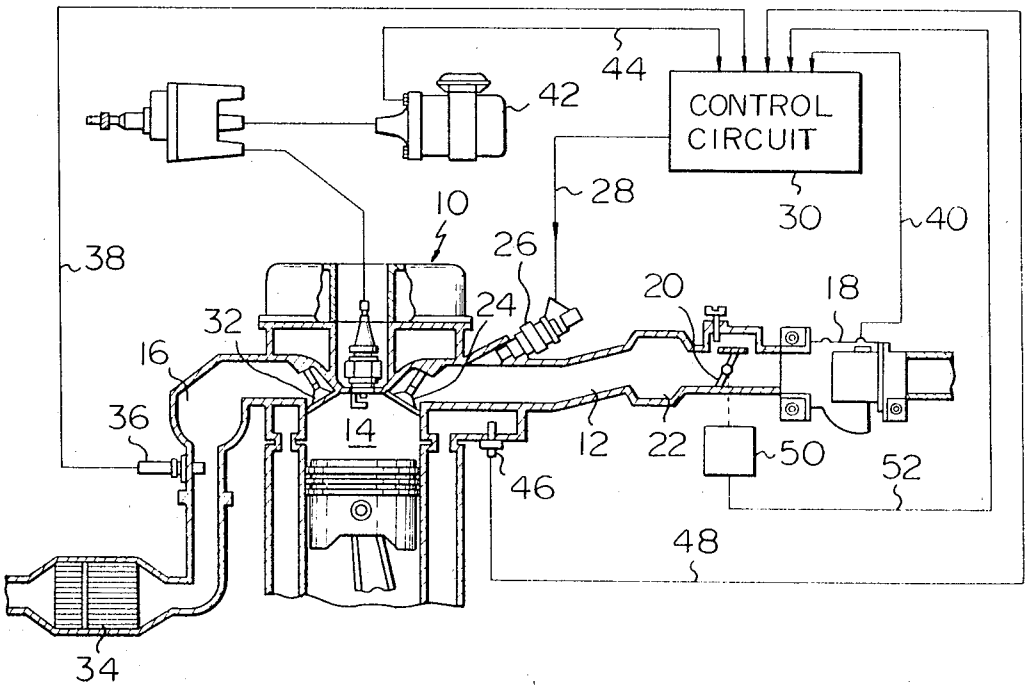
FIG. 1 is a schematic diagram illustrating an air-fuel ratio control system to which the present invention is used.

Referring to FIG. 1, which illustrates an air-fuel ratio control system of an electronically controlled fuel-injection type internal combustion engine as a preferred embodiment of the present invention, reference numeral 10 denotes an engine body, 12 an intake passage, 14 a combustion chamber, and 16 an exhaust passage. Air-flow sensor 18 measures the flow rate of the intake air introduced into the engine through an air cleaner (not shown). The intake-air flow rate is controlled by throttle valve 20 that is interlocked to an accelerator pedal (not shown). The intake air passing through throttle valve 20 is introduced to combustion chamber 14 via surge tank 22 and intake valve 24.

At least one fuel-injection valve 26 is intermittently opened in response to electrical drive pulses fed from control circuit 30 via line 28 and injects the compressed fuel fed from a fuel supply system (not shown) into the intake passage in the vicinity of intake valve 24.

The exhaust gas, which is produced by combustion in combustion chamber 14, is emitted to the atmosphere via exhaust valve 32, exhaust passage 16, and catalytic converter 34.

$O_2$ sensor 36, which generates a detection signal indicative of the concentration of the oxygen in the exhaust gas, is disposed at exhaust passage 16. The detection signal from $O_2$ sensor 36 is fed to control circuit 30 via line 38.

Air-flow sensor 18 is disposed on intake passage 12 upstream of throttle valve 20. The detection signal, which indicates the intake-air flow rate measured by air-flow sensor 18, is fed to control circuit 30 via line 40.

From a primary winding of ignition coil 42, primary ignition signals are fed to control circuit 30 via line 44.

An output signal from coolant-temperature sensor 46, which detects the temperature of the coolant in the engine, is fed to control circuit 30 via line 48.

Throttle-position switch 50, interlocked to throttle valve 20, produces a throttle-position signal which indicates whether or not throttle valve 20 is in the fully closed position. The throttle-position signal from throttle position switch 50 is fed to control circuit 30 via line 52.

Figure 2:
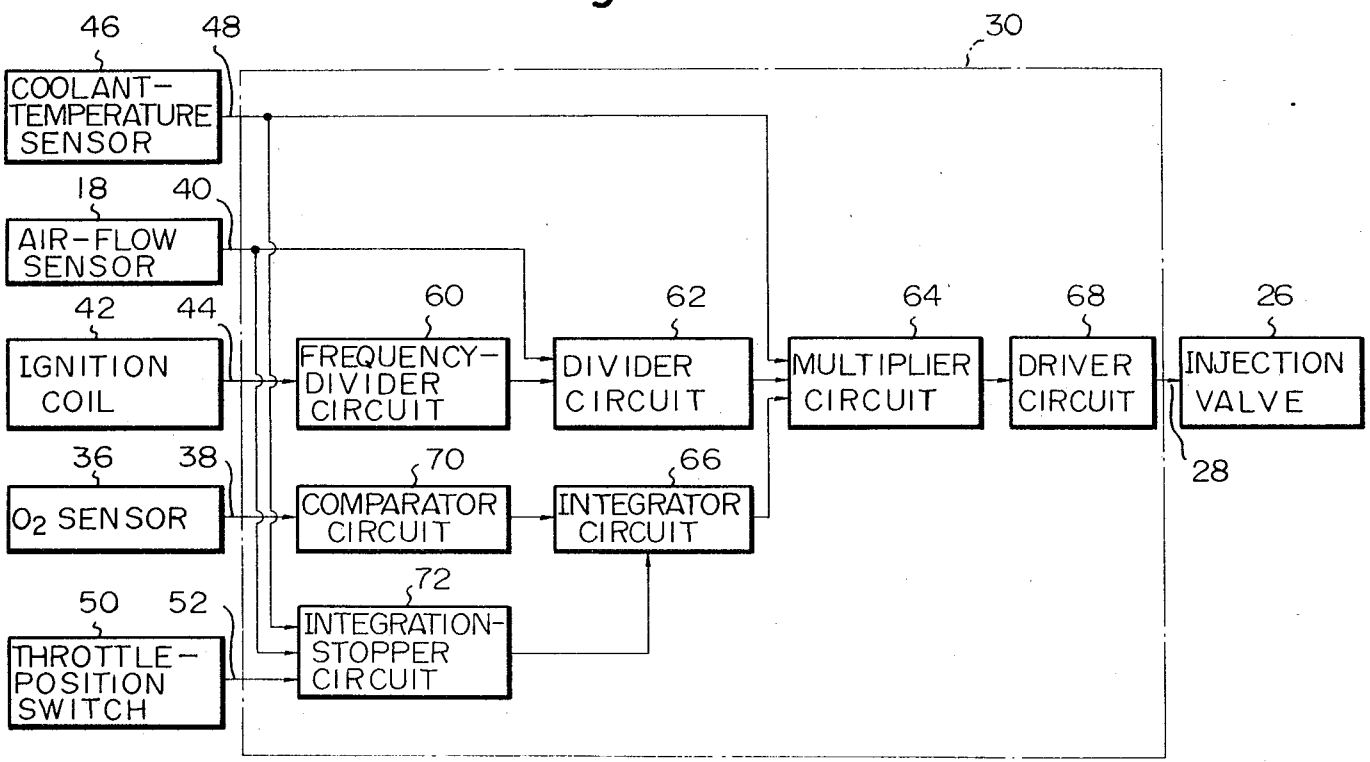
FIG. 2 is a block diagram illustrating the control circuit shown in FIG. 1.

FIG. 2 illustrates an embodiment of control circuit 30 shown in FIG. 1. In FIG. 2, coolant-temperature sensor 46, air-flow sensor 18, ignition coil 42, $O_2$ sensor 36, throttle-position switch 50, and fuel-injection valve 26 shown in FIG. 1 are represented by blocks.

The primary ignition signals fed from ignition coil 42 are applied to frequency divider circuit 60 where the waveform of the input signals are shaped and the frequency of the input signals is divided by a predetermined valve. The outputs from frequency divider circuit 60, which outputs are rectangular wave signals having a pulse width inversely proportional to rotational speed N of the engine, are applied to divider circuit 62. Divider circuit 62 is in fact composed of a charging-discharging circuit with respect to a capacitor. This charging-discharging circuit charges the capacitor by a constant current for a variable period of time corresponding to the pulse width of the output from frequency-divider circuit 60 and also controls the discharging current of the capacitor in response to the detection signal fed from air-flow sensor 18, which signal indicates intake-air flow rate Q. Thus, the output of charging-discharging circuit (divider circuit 62) is a rectangular wave signal having a pulse width corresponding to the discharging period of the capacitor. In other words, the pulse width of the output is proportional to Q/N.

The output from divider circuit 62 is applied to multiplier circuit 64. Multiplier circuit 64 further receives the detection signal indicative of the coolant temperature of the engine from coolant-temperature sensor 46 and a signal indicative of an air-fuel ratio correction factor from integrator circuit 66. Multiplier circuit 64 is composed of a charging-discharging circuit with respect to a capacitor and a logic sum circuit. The charging-discharging circuit charges the capacitor for a variable period which corresponds to the pulse width of the output from divider circuit 62, and controls the charging current and the discharging current of the capacitor responsive to the detection signal from coolant-temperature sensor 46 and to the signal from integrator circuit 66 so as to produce a correction pulse having a corrected pulse-width. The logic sum circuit produces a logic sum output of the above correction pulse and the output from divider circuit 62. That is to say, multiplier circuit 64 corrects the pulse width of the output from divider circuit 62 in accordance with the coolant temperature and with the air-fuel ratio correction factor.

The outputs from multiplier circuit 64 are applied to driver circuit 68 as injection pulse signals. Driver circuit 68 produces an intermittent drive current for energizing fuel-injection valve 26 depending upon the injection pulse signals. As a result, fuel of the amount depending upon the pulse width of the injection pulse signals is injected from fuel-injection valve 26.

The detection signal from $O_2$ sensor 36 is fed to comparator circuit 70 so as to discriminate whether the oxygen concentration in the exhaust gas is leaner or richer than a reference value, namely, whether the actual air-fuel ratio in the engine is on the lean side or rich side with respect to the stoichiometric air-fuel ratio. The output from comparator circuit 70 is applied to integrator circuit 66, which integrates the applied output with respect to time and produces an air-fuel ratio correction signal indicative of the air-fuel ratio correction factor.

Integration stopper circuit 72 produces a control signal for stopping the integration operation of integrator circuit 66 when the engine is under warm-up and furthermore the operating condition of the engine changes to acceleration. Warm-up is discriminated by comparing the detection signal from coolant-temperature sensor 46 with a predetermined reference value. The accelerating condition is, in this embodiment, discriminated either by comparing the increasing speed of the detection signal from air-flow sensor 18 with a predetermined reference value, or by checking whether throttle-position switch 50 is on or off.

Figure 3:
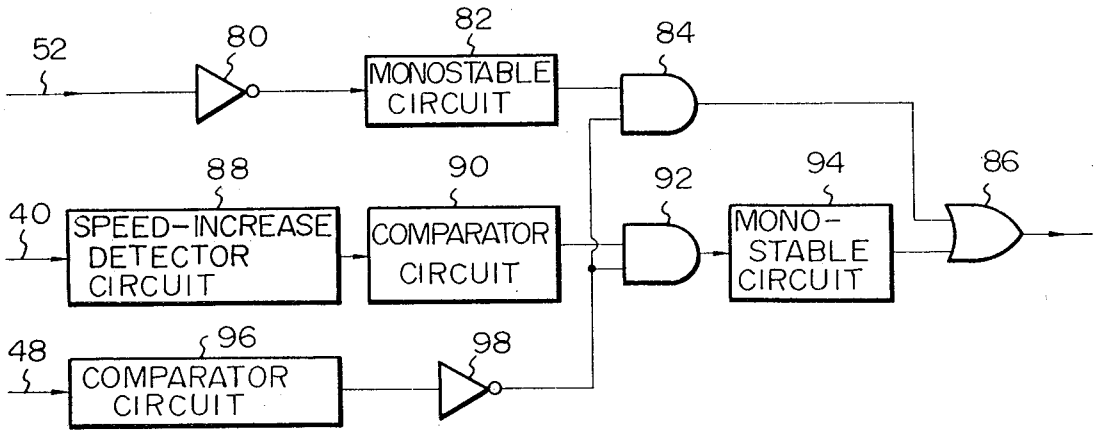
FIG. 3 is a block diagram illustrating one example of the integration stopper circuit shown in FIG. 2.

FIG. 3 illustrates an example of integration-stopper circuit 72. The output signal from throttle-position switch 50 is inverted at inverter 80 and then applied to monostable multivibrator circuit 82 of a positive-edge triggered type. Therefore, when the output signal from throttle-position switch 50 changes from "1" to "0", monostable multivibrator circuit 82 is triggered. Since throttle-position switch 50 produces a "1" level output signal when throttle valve 20 is in the fully closed position and produces a "0" level output signal when throttle valve 20 is opened, monostable multivibrator circuit 82 is triggered when throttle valve 20 is opened from the fully closed position to produce a single rectangular wave signal having a predetermined constant pulse-width, for example, 0.1 second pulse-width. The produced single rectangular wave signal from monostable circuit 82 is fed to integrator circuit 66, shown in FIG. 2, as an integration-stop signal, via OR gate 86 while AND gate 84 is being opened.

The detection signal from air-flow sensor 18, which signal is indicative of the intake-air flow rate, is applied to speed-increase detector circuit 88 and the speed increase thereof is detected. If the detected speed exceeds a predetermined value, "1" level signal is produced from comparator circuit 90 connected next to speed-increase detector circuit 88.

While AND gate 92 is being opened, the "1" level signal from comparator circuit 90 is applied to and triggers monostable multivibrator circuit 94 of a positive-edge triggered type. That is, when the speed increase of the intake-air flow rate exceeds a predetermined value and AND gate 92 is being opened, monostable multivibrator circuit 94 is triggered and, thus, a single rectangular wave signal having a predetermined constant pulse-width, for example 0.1 second pulse-width, is fed to integrator circuit 66 as the integration stop signal via OR gate 86.

The output signal from coolant-temperature sensor 46 is fed to comparator circuit 96 and then compared with a reference signal, which corresponds to the output signal from coolant-temperature sensor 46 at the coolant temperature of 70° C. Therefore, when the coolant temperature of the engine is equal to or lower than 70° C., in other words, when the engine is under warm-up, "0" level output is produced from comparator circuit 96. This "0" level output is applied to both AND gates 84 and 92 via inverter 98. As a result, AND gates 84 and 92 are opened only when the engine is under warm-up, and thus the integration-stop signal can be produced during this period.

Figure 4:
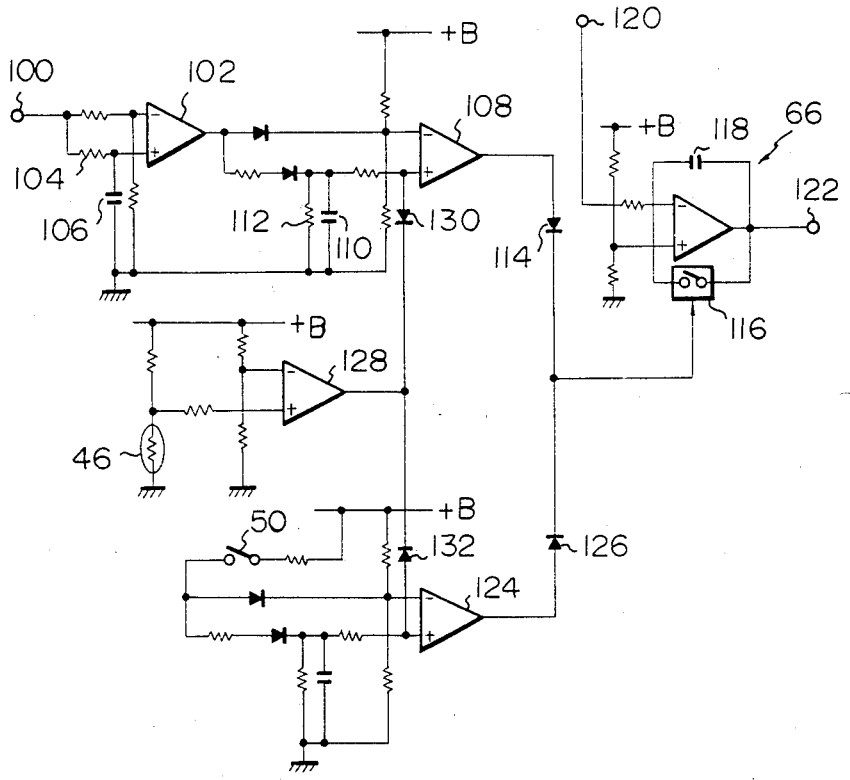
FIG. 4 is a circuit diagram illustrating the integration stopper circuit and the integration circuit in detail shown in FIG. 2.

FIG. 4 illustrates in detail integration-stopper circuit 72 and integrator circuit 66 shown in FIG. 2. In FIG. 4, terminal 100 receives a voltage signal which is proportional to the intake-air flow rate from air-flow sensor 18. The inverting input terminal of operational amplifier 102, which constitutes a comparator, receives the voltage proportional to the intake-air flow rate signal via voltage dividing resistors. The noninverting input terminal of operational amplifier 102 receives the voltage which corresponds to the integration value of the intake-air flow rate signal, via resistor 104 and capacitor 106 that constitute an integrator. Therefore, if the speed increase of the intake-air flow rate signal exceeds a predetermined value, the output of operational amplifier 102 inverts to the low level.

Operational amplifier 108 and its input circuit constitute a negative edge triggered type monostable multivibrator. When the input signal of this monostable multivibrator changes from a high level to a low level, operational amplifier 108 produces a high level signal. This high level signal is maintained until the voltage across capacitor 110 falls to less than the voltage at the inverting input terminal of operational amplifier 108 due to the discharge of capacitor 110 by way of resistor 112. The above-mentioned high level signal from operational amplifier 108 is fed to analog switch 116 in integrator circuit 66 via a diode which constitutes a part of an OR gate and makes analog switch 116 on. Thus, integration capacitor 118 is shorted, causing the integration operation to stop and furthermore causing the output of integrator circuit 66 to return to an initial value. In FIG. 4, input terminal 120 of integrator circuit 66 is connected to comparator circuit 70 in FIG. 2, and output terminal 122 of integrator circuit 66 is connected to multiplier circuit 64 in FIG. 2.

Throttle position switch 50, as mentioned hereinbefore, closes and generates a high level output when throttle valve 20 is in the fully closed position. Contrary to this, when throttle valve 20 opens, throttle position switch 50 opens and generates a low level output.

Operational amplifier 124 and its input circuit constitute a negative-edge triggered type monostable multivibrater. This monostable multivibrator produces a high level signal having a predetermined constant pulse-width when the output from throttle-position switch 50 changes from the low level to the high level. The produced high level signal from the monostable multivibrator (operational amplifier 124) is fed to analog switch 116 in integrator circuit 66 via a diode, which constitutes a part of the OR gate, and makes analog switch 116 on.

Coolant-temperature sensor 46 is composed of a thermistor. If the thermistor is connected as shown in FIG. 4, the input voltage applied to the noninverting input terminal of operational amplifier 128, which constitutes a comparator, increases when the coolant temperature lowers and decreases when the coolant temperature rises. The comparator (operational amplifier 128) thus produces a low level output if the coolant temperature is higher than or equal to a predetermined temperature, for example 70° C., and a high level output if lower than the predetermined temperature. If the high level output is produced from operational amplifier 128, diodes 130 and 132 are turned off, permitting operational amplifiers 108 and 124 to output high level signals. However, if the output from the operational amplifier 128 is low, diodes 130 and 132 are turned on, causing the noninverting input voltage of operational amplifiers 108 and 124 to hold the low level. Therefore, these operational amplifiers 108 and 124 cannot output high level signals. That is, the stoppage control of the integration operation can be executed only when the engine is under warm-up (under cold condition).

Figure 5:
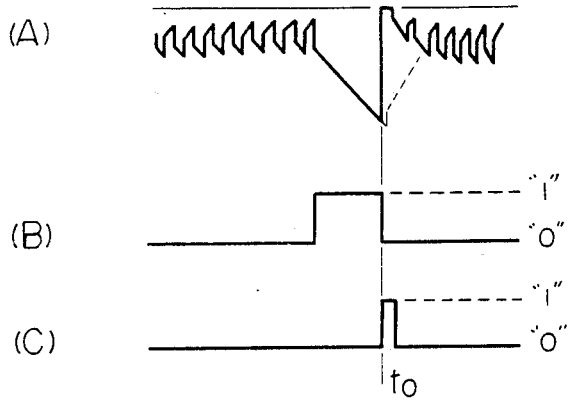
FIGS. 5(A-C) is a time chart for explaining the operation of the present invention.

FIG. 5 illustrates the wave forms of various signals for explaining the operation of the present invention. In FIG. 5, (A) indicates the wavefrom of the air-fuel ratio correction signal, (B) indicates the waveform of the signal from the throttle-position switch, and (C) indicates the waveform of an integration-stop signal produced from the monostable multivibrators when the increasing speed of the intake-air flow rate exceeds a predetermined value or when the throttle-position switch opens.

When throttle valve 20 is fully closed during warm-up, the air-fuel ratio correction signal continuously decreases, as shown in FIG. 5(A), so as to control the air-fuel ratio toward the lean side. By way of explanation, supposing that throttle valve 20 opens and the intake-air flow rate suddenly increases to start the acceleration at time $t_o$. According to conventional air-fuel ratio control, the airfuel ratio correction signal slowly increases from a lower value thereof just before $t_o$, as shown by a broken line in FIG. 5(A). Therefore, good acceleration characteristics cannot be obtained. However, according to the present invention, the integration-stop signal shown in FIG. 5(C) is produced at time $t_o$ so as to stop the integration operation and so as to rapidly return the air-fuel ratio correction signal to the initial value, which corresponds to a value of the air-fuel ratio correction signal when the correction amount is zero. Therefore, according to the present invention, the fuel is not greatly decreased by the closed-loop air-fuel ratio control when the acceleration is started, thus preventing sluggish acceleration and backfire.

In the above-mentioned embodiment, the discrimination whether or not the engine is under acceleration is performed not only by checking whether or not the speed increase of the intake-air flow rate exceeds a predetermined speed but also by checking whether or not the throttle valve is in the fully closed position. This is because since the change in the intake-air flow rate is generally very small when the throttle value opens slightly from the fully closed position, the accelerating condition cannot be completely detected only by checking the speed increase of the intake-air flow rate.

Figure 6:
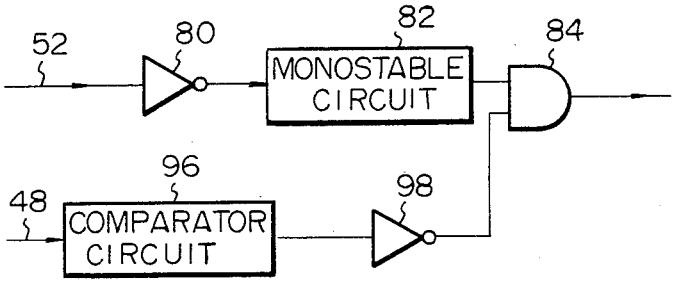
FIGS. 6 and 7 are block diagrams illustrating other examples of the integration stopper circuit shown in FIG. 2.
Figure 7:
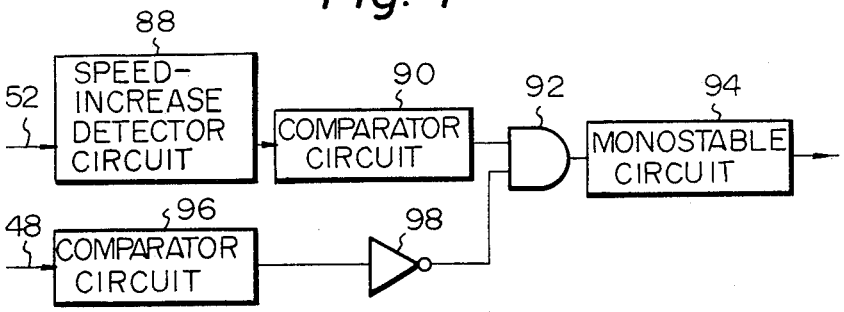

However, the present invention can be performed either by checking the speed increase of the intake-air flow rate or by checking the throttle-valve position. FIG. 6 illsutrates an example of integration-stopper circuit 72, which discriminates whether or not throttle valve 20 is in the fully closed position. FIG. 7 illustrates another example of integration-stopper circuit 72, which discriminates whether or not the speed of increase the intake-air flow rate is higher than a predetermined value. The construction and operation of these two examples are the same as that of the corresponding portions of integration-stopper circuit 72 shown in FIG. 3.

As will be apparent from the above-mentioned description, according to the present invention, when the engine is under acceleration during warm-up, the closed-loop air-fuel ratio control operation is stopped and the air-fuel ratio correction factor is fixed to a predetermined value for a certain period. No sluggish acceleration and no back fire occur at the start of a acceleration during warm-up. In other words, according to the present invention, good acceleration characteristics can be obtained during warm-up.

As many widely different embodiments of the present invention may be constructed without departing from the spirit and scope of the present invention, it should be understood that the present invention is not limited to the specific embodiments described in this specification, except as defined in the appended claims.

We claim:

1. An air-fuel ratio control method for an internal combustion engine, including the steps of:

detecting the concentration of a predetermined component of the exhaust gas;

calculating, as a function of detected concentration, an air-fuel ratio correction factor to obtain a stochiometric air-fuel ratio;

detecting an engine temperature;

correcting an amount of fuel supplied to the engine in accordance with said detected engine temperature under an engine warm-up condition;

correcting with closed-loop control the amount of fuel supplied to the engine in accordance with said air-fuel ratio correction factor, said closed-loop correcting being performed even when the engine is under a warm-up condition;

determining whether the engine is under a warm-up condition;

determining whether the engine is under an accelerating condition;

stopping closed-loop air-fuel ratio control for a predetermined constant period of time by fixing said air-fuel ratio correction factor to a predetermined constant value when the engine is determined to be in both the accelerating and warm-up conditions, said predetermined constant value being equal to a value of the air-fuel ratio correction factor at a time when the closed-loop air-fuel ratio correction amount is zero; and resuming closed-loop air-fuel ratio control when said predetermined constant period of time has elapsed to subsequently obtain a stoichiometric air-fuel ratio under the accelerating condition.

2. An air-fuel ratio control method as claimed in claim 1, wherein said method further comprises a step of inhibiting the stoppage of the closed-loop air-fuel ratio control after the engine is fully warmed-up.

3. An air-fuel ratio control method as claimed in claim 1, wherein said accelerating condition detecting step includes a step of detecting whether or not the throttle valve of the engine is opened from the fully closed position.

4. An air-fuel ratio control method as claimed in claim 1, wherein said accelerating condition detecting step includes a step of detecting whether or not the speed increase of the intake-air flow rate of the engine exceeds a predetermined value.

5. An air-fuel ratio control apparatus for an internal combustion engine comprising:

means for detecting the concentration of a predetermined component of the exhaust gas;

means for calculating, as a function of said detected concentration, an air-fuel ratio correction factor to obtain a stochiometric air-fuel ratio;

means for detecting an engine temperature;

means for correcting an amount of fuel supplied to the engine in accordance with said detected temperature under an engine warm-up condition;

means for correcting by closed-loop control the amount of fuel supplied to the engine, in accordance with said air-fuel ratio correction factor, correction being performed even when the engine is under a warm-up condition, means for determining whether the engine is under a warm-up condition;

means for determining whether the engine is under an accelerating condition;

means for stopping closed-loop air-fuel ratio control for a predetermined constant period of time by fixing said air-fuel ratio correction factor to a predetermined constant value when the engine is determined by said detecting means to be in both the accelerating and warm-up conditions, said predetermined constant value being equal to a value of the air-fuel ratio correction factor at a time when the closed-loop air-fuel ratio correction amount is zero; and means for resuming closed-loop air-fuel ratio control when said predetermined constant period of time has elapsed to subsequently obtain a stoichiometric air-fuel ratio under the accelerating condition.

6. An air-fuel ratio control apparatus as claimed in claim 5, wherein said apparatus further comprises means for inhibiting the stoppage of the closed-loop air-fuel ratio control after the engine is fully warmed-up.

7. An air-fuel ratio control apparatus as claimed in claim 5, wherein said accelerating condition detecting means includes means for detecting whether of not the throttle valve of the engine is opened from the fully closed position.

8. An air-fuel ratio control apparatus as claimed in claim 5, wherein said accelerating condition detecting means includes means for detecting whether or not the speed increase of the intake-air flow rate of the engine exceeds a predetermined value.

* * * * *